US005175993A

United States Patent [19]

Raiko et al.

[11] Patent Number: 5,175,993

[45] Date of Patent: Jan. 5, 1993

[54] COMBINED GAS-TURBINE AND STEAM-TURBINE POWER PLANT AND METHOD FOR UTILIZATION OF THE THERMAL ENERGY OF THE FUEL TO IMPROVE THE OVERALL EFFICIENCY OF THE POWER-PLANT PROCESS

[75] Inventors: Markku Raiko, Espoo; Martti Äijälä, Helsinki, both of Finland

[73] Assignee: Imatran Voima Oy, Finland

[21] Appl. No.: 767,241

[22] Filed: Sep. 27, 1991

Related U.S. Application Data

[63] Continuation of Ser. No. 466,405, Feb. 22, 1990, abandoned.

[30] Foreign Application Priority Data

Jun. 30, 1988 [FI] Finland ..... 883124

[51] Int. Cl.[5] ..... F02C 3/26

[52] U.S. Cl. ..... 60/39.05; 60/39.182; 60/39.464

[58] Field of Search ..... 60/39.02, 39.05, 39.12, 60/39.182, 39.464

[56] References Cited

U.S. PATENT DOCUMENTS

| | | | |
|---|---|---|---|
| 2,677,234 | 5/1954 | Secord | 60/39.02 |
| 2,677,236 | 5/1954 | Grinsted | 60/39.05 |
| 3,990,229 | 11/1976 | Staege | 60/39.12 |
| 4,866,928 | 9/1989 | Raiko | 60/39.05 |
| 4,976,101 | 12/1990 | Schiffers | 60/39.12 |

FOREIGN PATENT DOCUMENTS 730991 4/1980 U.S.S.R. .

OTHER PUBLICATIONS

Derwent Abstract No. L9895c/50, SU730991.

*Primary Examiner*—Louis J. Casaregola
*Attorney, Agent, or Firm*—Steinberg & Raskin

[57] ABSTRACT

The invention concerns a combined gas-turbine and steam-turbine power plant, which comprises heat transfer members which interconnect a pressurized dryer (26) and waste-heat recovery members (22), by means of which the recovered thermal energy of the exhaust gases from the gas turbine (20) can be transferred directly or through the steam turbine into the dryer (26) for the drying of a water-containing material, advantageously fuel, and for the passing of the steam produced as injection steam to the gas turbine (20). The invention also concerns a method for improving the efficiency of a power-plant process.

11 Claims, 3 Drawing Sheets

COMBINED GAS-TURBINE AND STEAM-TURBINE POWER PLANT AND METHOD FOR UTILIZATION OF THE THERMAL ENERGY OF THE FUEL TO IMPROVE THE OVERALL EFFICIENCY OF THE POWER-PLANT PROCESS

This is a continuation of application Ser. No. 07/466,405, filed Feb. 22, 1990 (abandoned).

The present invention concerns a combined gas-turbine and steam-turbine power plant.

The invention also concerns a method for utilization of the thermal energy of the fuel to improve the overall efficiency of the power-plant process.

In a combined power plant, both a gas turbine and a steam turbine are fitted to generate electricity. In typical processes of combined power plants, the input water of the steam-turbine circuit is circulated to cool the exhaust gases of the gas turbine. In the present power plants, a pre-dried solid fuel, e.g. peat, is used, which said fuel is burned as unpressurized, e.g., in a grate furnace, by dust burning, or by fluid bed combustion. A problem is caused by the drying of wet fuel. In order to obtain an optimal combustion result, it has been necessary to pre-dry the fuel. The present dryer combinations are not optimally suitable for processes of combined power plants. In particular, burning of peat in small power plants with the present-day boilers has been uneconomical.

The object of the present invention is to eliminate the drawbacks occurring in the technique described above and to provide a combined gas-turbine and steam-turbine power plant of an entirely new type which uses fuel that contains water as well as a method for utilization of the thermal energy of the fuel to improve the overall efficiency of the power-plant process.

The invention is based thereon that the fuel is dried by means of the waste heat of the gas turbine in a pressurized dryer, and the water vapour produced in the drying is supplied as injection steam to the gas turbine. In one embodiment of the invention the steam of the steam turbine is superheated in the same combustion unit in which gas is formed for the gas turbine. In one embodiment of the invention, waste heat from the gas turbine is transferred to the steam-turbine process, and bled steam of lower value obtained from the steam-turbine process is used for the drying.

The method of the invention is mainly characterized in that the material that contains water, advantageously fuel, is dried under pressure, at least partly by means of the thermal energy of the flue gases after the gas turbine, in a pressurized dryer, and the steam produced in the drying is supplied as injection steam to the gas turbine.

In a combined gas-turbine-steam-turbine power plant in accordance with the invention, the fuel is dried under pressure and the steam produced in the drying is supplied into the pressurized part of the process, e.g. to the combustion or gasification unit.

The combined power plant in accordance with the invention is mainly characterized in that the combined gas-turbine and steam-turbine power plant comprises heat transfer members which interconnect the pressurized dryer and the waste-heat recovery members, by means of which the recovered thermal energy of the exhaust gases from the gas turbine can be transferred directly or through the steam turbine into the dryer for the drying of the water-containing material, advantageously fuel, and for the passing of the steam produced as injection steam to the gas turbine.

The method of the invention is mainly characterized in that the material that contains water, advantageously fuel, is dried under pressure, at least partly by means of the thermal energy of the flue gases after the gas turbine, in a pressurized dryer, and the steam produced in the drying is supplied as injection steam to the gas turbine.

In the process in accordance with the invention, exhaust gases from the gas turbine are used. Advantageously, in an embodiment of the invention, heat obtained from the steam turbine process is also used to generate steam in the dryer. Said steam is passed into the combustion chamber of the gas turbine, where it substitutes for part of the air arriving through the compressor. At the same time, the power requirement of the compressor is reduced and an increased proportion of the output of the turbine is converted to generator power. The net output obtained from the gas turbine is increased even by about 40 per cent. Thereat, the efficiency of the gas turbine is increased by about 25 per cent as a result of the fact that the ultimate temperature of the flue gases is lowered.

An abundance of air is needed because by its means the temperature in the combustion chamber is kept at the desired level, i.e. at a level that is tolerated by the materials. When air is substituted for, for the purpose of cooling, by the steam produced in the dryer, the power required for the compressing of the air becomes lower, and more power is available to the generator. In the dryer the generation of steam requires thermal power, which is taken from the waste heat of the flue gases and/or from bled steams of the steam turbine.

According to the invention, the injection steam is generated from the water obtained from the fuel dried in a pressurized dryer, and as the energy required for said drying is used the waste heat from the gas turbine and/or advantageously also the energy obtained from bled steams from the steam turbine in the combined plant. Waste heat of the gas turbine can also be transferred to the steam-turbine process.

By means of a combined power plant in accordance with the invention it is possible to utilize the thermal energy of the fuel without any complicated pre-treatment of the fuel. Particular advantages are also obtained, e.g., in the combustion of peat and brown coal. Thereat, the moisture contained in the fuel does not lower the process efficiency, but the moisture can be utilized. When the fuel consists of peat, in an optimal case only mechanical compression of the peat is necessary, whereby pre-treatment of the peat on the bog and drying of the peat material are omitted.

In the following, the invention will be examined in more detail with the aid of the exemplifying embodiment in accordance with the attached drawing.

Figure 1:
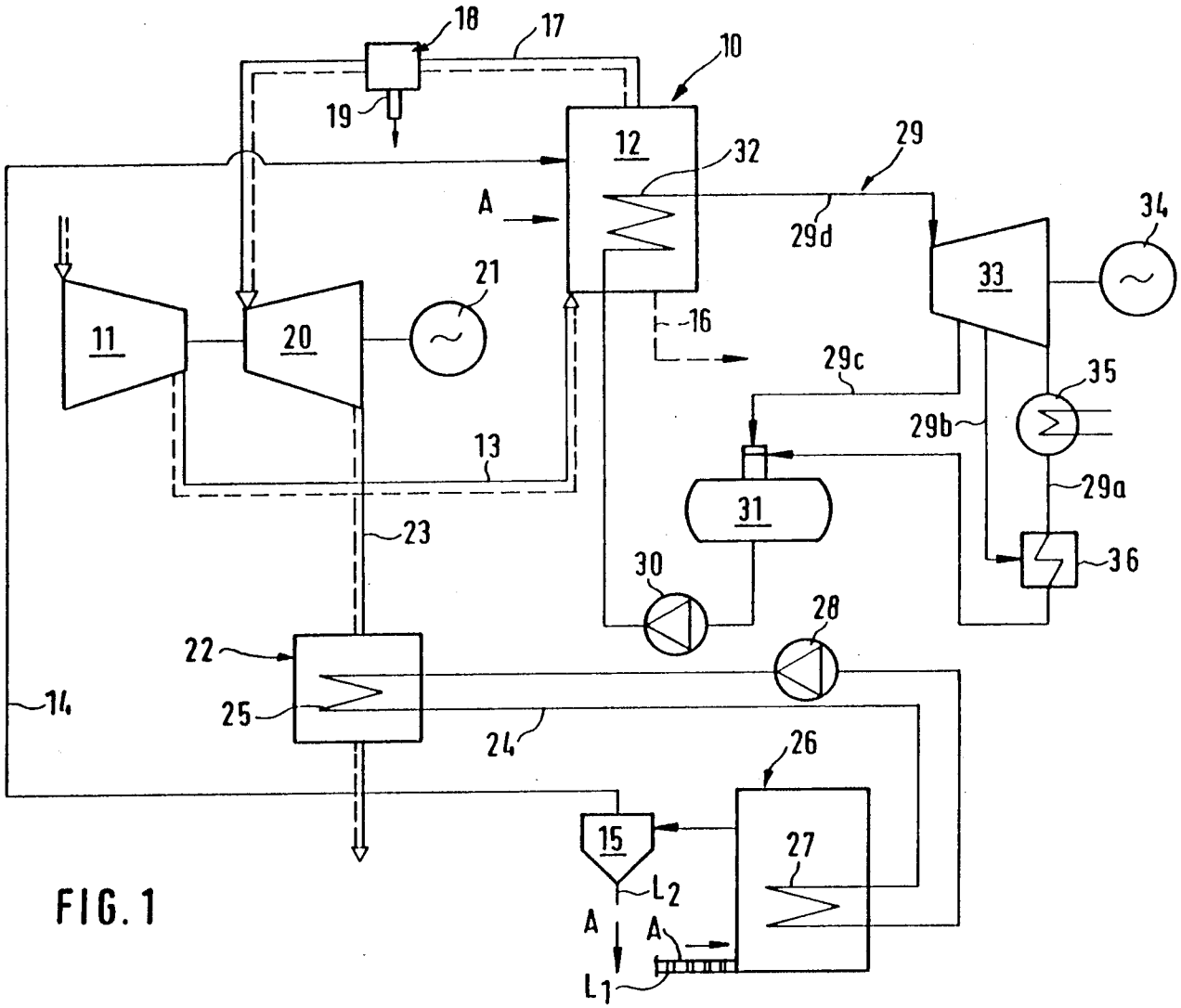
FIG. 1 is a schematical illustration of a gas-steam-turbine plant in accordance with the invention which uses water-containing fuel.

As is shown in FIG. 1, the fuel is burned in a pressurized combustion or gasification unit or combustion device 10, which comprises a combustion chamber 12 pressurized by means of a compressor 11. The compressor 11 produces the necessary combustion air, which is passed into the combustion device 10 through a system of compressed-air pipes 13. The compressor 11 raises the air pressure, e.g., to 12 bars. The pressure may be typically within the range of 5 . . . 50 bars. At said pressure, the air is then passed into the combustion device 10. Fuel A is fed into the combustion device 10. Owing to the burning of the fuel, the mixture of air and of the flue gases produced during combustion of the fuel is heated to about 850° . . . 1200° C. Into the combustion device 10, through the steam pipe 14, at least part of the steam is introduced that was separated in the steam separator 15 from the fuel flow. The steam and the fuel may also be passed as a mixture along the duct 14, in which case no fuel separator 15 is needed. One objective of the supply of steam is regulation of the ultimate temperature in the combustion chamber. In such a case, the steam is substituted for some of the excess air that is normally needed. Owing to the supply of steam, the compressor power is lowered and the net output of the process is increased. Advantageously, a hot cleaner 18 for gases is placed in the duct 17. Part of the ashes from the fuel are removed from the combustion device 10 along the duct 16 straight out of the system, whereas the rest of the ashes pass along with the flue-gas flow into the flue-gas pipe system 17 and further to the hot cleaner 18 for flue gases, where more contaminated gas and the ashes are removed out of the process through the outlet duct 19.

After the cleaner 18 for flue or combustion gases the gases are passed further along the gas-pipe system 17 to the gas turbine 20, where the gases expand and generate kinetic energy. By means of the kinetic energy, the compressor 11 placed on the same shaft as well as the generator 21 are rotated, said generator 21 producing electricity. The pressure of the flue gases is lowered to the level of the environment while, at the same time, performing the work mentioned above in the gas turbine 20. The output obtained from the gas turbine 20 is higher than the power required by the compressor 11, whereby the excess power is recovered from the generator 21 of the gas turbine. After the gas turbine 20, the flue gases are passed into a separate device 22 for the recovery of waste heat, for example into a waste-heat boiler, along the duct 23. The temperature of the flue gases after the gas turbine 20 is typically 400° . . . 600° C. These gases are cooled to about 120° C. in the device 22 for the recovery of heat, e.g. a waste-heat boiler. The heat obtained from the flue gases by means of the device 22 for the recovery of heat is transferred to drying of the fuel A in the dryer. After the heat-recovery device 22 the flue gases are removed out of the plant: In the heat-recovery device 22 it is possible to generate steam, superheat stem, or to preheat the circulation water, which is then passed further to the heat-exchanger of the dryer, where the heat is transferred into the material to be dried.

The circulation pipe system 24 for the heat transfer medium, advantageously water and/or steam, includes, in the heat-recovery device 22, advantageously a waste-heat boiler, a heat exchanger 25 and, in a corresponding way, in the dryer 26, another heat exchanger, advantageously a condenser 27. A pump 28 circulates the heat transfer medium, advantageously water, in the circulation pipe system 24.

In the heat-recovery device 22, heat is transferred from the flue gases through the heat exchanger 25 into the water in the circulation pipe system 24, whereby the water is vaporized, and said steam is carried by means of the pump 28 into the heat exchanger 27 present in the dryer 26, where the heat is transferred further into the material to be dried.

In the steam-turbine process the supply-water pipe system 29 also includes a supply-water pump 30. The pump 30 is fitted to pump supply water of the steam turbine 33 in the supply-water pipe system 29 from the supply-water tank 31 to the steam generator 32 placed in the combustion device 10.

The steam-turbine process includes a steam generator 32, a steam turbine 33, a generator 34 that produces electricity and is connected to the steam turbine 33, and a condenser 35 and a pre-heater of supply water. In the embodiment of the invention shown in the figure, the combustion chamber 12 of the gas turbine 20, at the same time, also acts as the boiler of the steam-turbine process, wherein the steam passed to the steam turbine 33 is generated. Thus, by means of the fuel A burned in the combustion chamber 12 of the gas turbine 20, it is possible both to heat the gases that pass to the gas turbine 20 and to generate steam for the steam-turbine process in the steam generator 32. The temperature of the steam arriving in the steam turbine 33 is typically 530° C. and the pressure 100 . . . 180 bars. The pressure prevailing in the condenser 35 is typically 0.05 bar, and the temperature thereat 30° C. In the condenser 35, the steam is condensed to water. By means of the supply-water pump 30, the pressure of the condensed water is again raised to the level of the boiler pressure. The supply water is pumped by means of the pump 30 from the tank 31 to the steam generator 32, which is placed in the combustion chamber 12 of the gas turbine 20, as was described above.

From the steam turbine 33 a connecting duct **29*a* passes through the condenser 35 and the pre-heater 36 to the tank 31. From the steam turbine 33 a connecting duct 29*b* passes to the pre-heater 36 for the purpose of pre-heating of the supply water of the line 29*a*, taking place by means of bled steam. From the steam turbine 33 a connecting duct 29*c* passes to the tank 31. From the tank 31 a connecting duct 29*d* passes through the pump 30 and the vaporizer 32 to the steam turbine 33**.

The drying of the water-containing fuel A takes place in the pressurized dryer 26 at the combustion pressure. The wet fuel A that contains water is fed into the dryer 26 typically to a pressure of about 12 bars. In the dryer 26, the wet fuel A becomes dry and, at the same time, steam at the combustion pressure is generated. Said steam is used as injection steam for the gas turbine 20 by passing the steam into the combustion device, i.e. the combustion unit 10. The dry fuel A is passed out of the dryer 26 into the combustion device 10 along a transportation path $L_1$ of its own.

In the following, the process of drying of the fuel A will be described in more detail.

The fuel flow A is passed along the duct $L_1$ or some other, corresponding supply path into the dryer 26. As the fuel A, it is possible to use, e.g., milled peat of a moisture content of 70%. In the process in accordance with the invention, it is also possible to use fuel, in particular peat, which has been dried only mechanically and whose moisture content may be even higher than 75%. The drying takes place in the pressurized dryer 26 at the combustion pressure, advantageously at a pressure of about 12 bars. In the present application, a pressurized dryer is to be understood as a dryer whose drying space is at a positive pressure relative the atmospheric pressure. In such a case, the moisture contained in the fuel A is obtained as a medium in the process. The steam produced in the drying is passed along the duct 14 into the combustion device 10 of the gas turbine 20 into its combustion chamber 12. In principle, the fuel A may be any solid or liquid fuel that contains water. In the pressurized dryer the moist fuel is dried, e.g., to a moisture content of 20%. The drying energy for the dryer 26 is obtained along the pipe system 24 from the recovery 22 of the heat from the flue gases of the gas turbine 20.

In the combustion device 10, the fuel A may be either burned directly, or such a solution is also possible in which direct burning is replaced by gasification or partial gasification of the fuel and by burning of the gas produced.

Purification of the gas may take place at the combustion or gasification temperature or at some lower temperature. The steam produced in the dryer 26 is passed along the duct 14 as injection steam into the combustion or gasification device or into some part of the pressurized gas line, either before or after the combustion or gasification device 10. It is not necessary to separate the steam and the peat in a steam separator device 15, but the fuel and the steam produced can also be passed as a mixture into the combustion or gasification device 10.

Within the scope of the invention, such an embodiment is possible in which a water-containing material in general is dried in the dryer. The fuel of the power-plant process may be some material other than that treated in the dryer.

Figure 2:
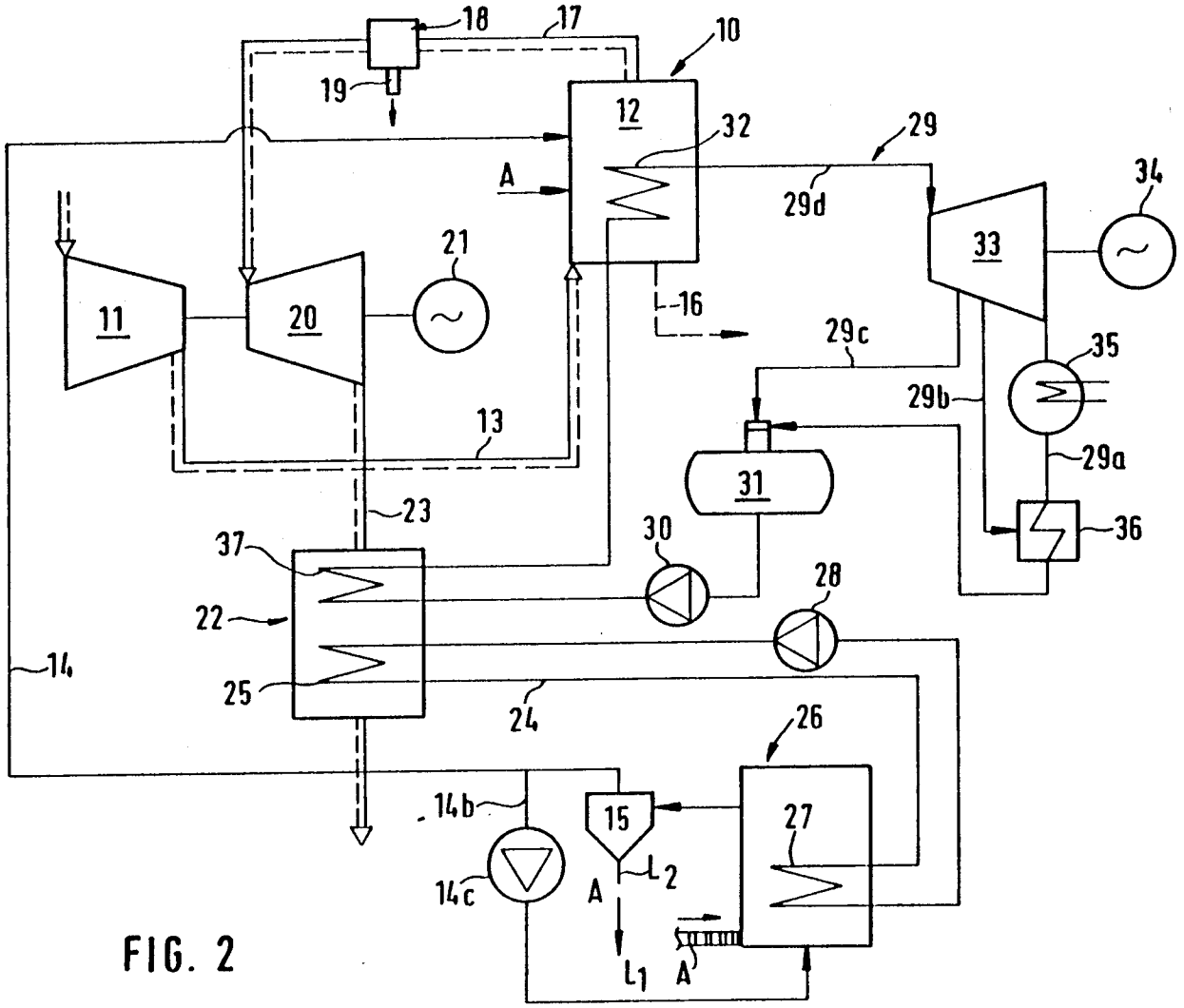
FIG. 2 shows a second advantageous embodiment of a gas-steam-turbine plant in accordance with the invention.

FIG. 2 illustrates an embodiment of the invention wherein the supply water for the steam-turbine process is pre-heated by means of the energy obtained from the flue gases of the gas turbine in the heat-recovery recovery device 22. In this embodiment shown in the figure, in the heat-recovery device, the heat from the flue gases can be transferred both to the drying of the fuel A in the dryer 26 and to the steam-turbine process for preheating of the supply water for the steam turbine 33 or for vaporization of the supply water for the steam-turbine process or for superheating of said steam. In the other respects, the embodiment shown in FIG. 2 is fully equivalent to the embodiment of FIG. 1. In the heat-recovery device 22, a heat exchanger 37 is placed, which is connected with the supply-water pipe system 29.

From the steam turbine 33 a connecting duct 29*a* passes through the condenser 35 and the pre-heater 36 to the tank 31. From the steam turbine 33 a connecting duct 29*b* passes to the pre-heater 36 for pre-heating of the supply water of the line 29*a*, taking place by means of bled steam. From the steam turbine 33 a connecting duct 29*c* passes to the tank 31. From the tank 31 a connecting duct 29*d* passes through the pump 30, the heat exchanger 37 and the vaporizer 32 to the steam turbine 33.

FIG. 2 shows an embodiment of the invention wherein the steam produced in the drying is circulated in the circulation circuit 14*b* by means of the pump 14*c* and part of the steam is taken along the duct 14 to constitute injection steam.

The dryer may also operate by means of some other principle, such as, for example, so that the steam produced in the dryer is superheated and recirculated as superheated into the dryer and, under these circumstances, no internal heat-transfer pipe system in the dryer is needed.

Figure 3:
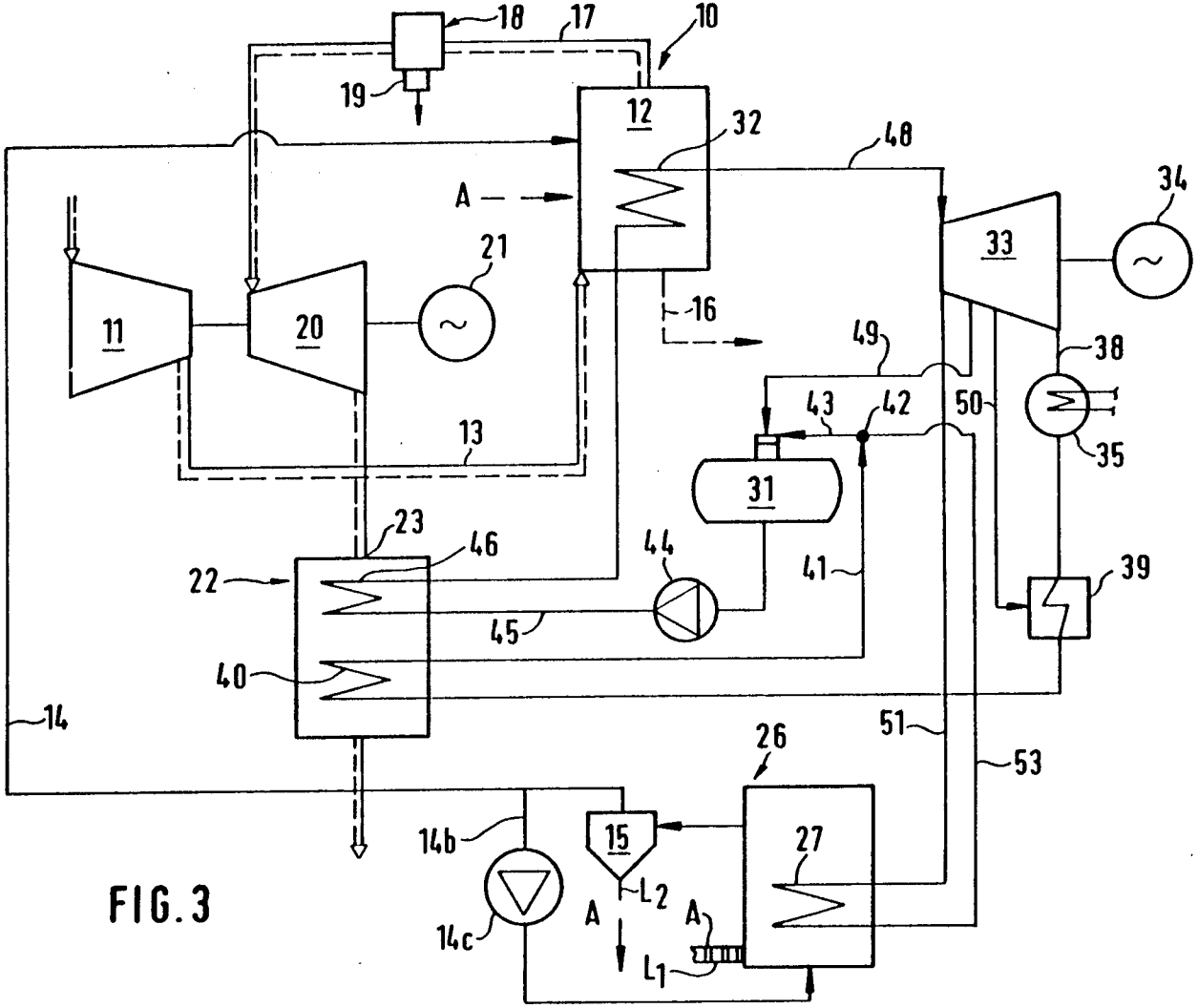
FIG. 3 shows a third advantageous embodiment of the gas-steam-turbine plant.

FIG. 3 shows a third advantageous embodiment of the invention as a schematical illustration. In this embodiment of the invention, the heat is recovered from the waste heat of the gas turbine in the heat-recovery device 22, and said heat is transferred to pre-heating of the supply water. In this embodiment of the invention, the supply water of the steam turbine in the steam-turbine process is circulated through the heat-recovery device 22 placed in the flue-gas duct of the gas turbine and, further, said supply water is circulated into the steam generator 32 placed in the combustion device 10 and, further, said superheated steam is transferred to the steam turbine 33. This embodiment of the invention differs from the embodiments described above in the respect that heat obtained from bled steams of the steam turbine is used for the drying of fuel in the dryer.

Within the scope of the invention, a solution is possible that differs from the embodiment shown in FIG. 2 in the respect only that the supply water of the steam-turbine process is circulated through the waste-heat boiler 22 only.

In the embodiment of the invention shown in FIG. 3, the supply water passes from the condenser 35 along the system of ducts 38 through the heat exchanger 39 to the heat exchanger 40 placed in the device 22 for the recovery of the heat from the flue gases of the gas turbine 20, from which said heat exchanger 40 the supply water is carried further along the connecting duct 41 through the branching point 42 along the duct 43 to the supply-water tank 31. From the supply-water tank 31 the supply water is pumped by means of the pump 44 along the duct 45 to the heat exchanger 46 placed in the heat-recovery device 22. Along the duct 47, the pre-heated supply water is pumped by means of the pump 44 into the pipe system of the vaporizer 32 placed in the combustion device 10 and further along the connecting duct 48 to the steam turbine 33. From the steam turbine 33, a connecting duct 49 for bled steam passes to the supply-water tank 31. The duct 50 is passed to the pre-heater 39 for supply water, and in this way bled steam from the steam turbine 33 is used for pre-heating of the supply water passed along the duct 38.

Further, from the steam turbine 33 a duct 51 for bled steam passes to the pressurized dryer 26. The duct 51 passes through the heat exchanger 52 placed in the dryer 26, and further the condensed water coming from the dryer is passed along the duct 53 through the branching point 42 to the duct 43 and further to the supply-water tank 31. The branching may also be made to some other part of the supply-water line.

Thus, in the embodiment of the invention shown in FIG. 3, the fuel A is dried by means of heat obtained from bled steams of the steam turbine. In the embodiment of FIG. 3, the supply water that is carried to the steam generator 32 is pre-heated by means of thermal energy obtained from the flue gases of the gas turbine 20. In the embodiment of FIG. 3, in the way corresponding to the embodiments shown in FIGS. 1 and 2, the fuel is passed through the steam separator 15, from which at least part of the steam is passed along the duct 14 as injection steam into the combustion device 10, and further the dried fuel A is carried along the path $L_2$ as fuel to the combustion or gasification device 10 of the gas turbine and the steam turbine. In the embodiment of FIG. 3, the steam produced in the dryer 10 is recirculated in the same way as in the embodiment of FIG. 2.

Within the scope of the invention, an embodiment is also possible wherein the steam produced in the drying in the pressurized dryer is recirculated through some waste-heat boiler, e.g. through the waste-heat boiler 22 of the gas turbine, and in which said boiler the steam is superheated, whereinafter said steam is passed back into the dryer. Part of the recirculation steam is taken as injection steam to the gas turbine 20.

Within the scope of the present invention, the dryer used is not bound to any particular dryer type.

What is claimed is:

1. A combined gas-turbine and steam-turbine power plant which uses a fuel containing water comprising a gas turbine, a combustion unit for burning fuel, a pressurized dryer for drying fuel to be fed into said combustion unit, said pressurized dryer generating pressurized steam during the drying of the fuel, a compressor driven by said gas turbine, said compressor pressurizing said combustion unit in order to combust the fuel, a flue gas pipe connecting said combustion unit to said gas turbine and feeding the flue-gas combustion products of the fuel to said gas turbine, a first generator driven by said gas turbine, said generator producing electric energy, waste recovery means connected in proximity to an outlet of said gas turbine, said waste recovery means recovering thermal energy from the flue gases, a steam turbine, the supply water for said steam turbine being circulated through and heated in said combustion unit, a second generator driven by said steam turbine, said second generator producing electric energy, heat transfer means, said heat transfer means connecting said pressurized dryer to said waste-energy recovery means, such that recovered thermal energy is transferred to said pressurized dryer for drying the fuel, a duct connecting said pressurized dryer to said combustion unit of said gas turbine, and means for injecting pressurized steam produced in said pressurized dryer into said combustion unit, such that the pressure of the steam conducted into said combustion unit is substantially the same as the pressure in said combustion unit.

2. The apparatus of claim 1, further comprising heat-recovery members transferring waste heat from said gas turbine to said steam turbine such that the waste heat pre-heats the supply water for said steam turbine or the waste heat generates steam or superheats the steam.

3. The apparatus of claim 1, wherein said heat transfer means transfer the thermal energy of said steam of said steam turbine to said pressurized dryer for drying the fuel.

4. A method for utilizing thermal energy produced in the combustion of a fuel in a combined gas-turbine and steam-turbine power plant, comprising drying a fuel that contains water in a pressurized dryer, and generating pressurized steam during the drying of the fuel, feeding the dried fuel into a pressurized combustion unit of a gas turbine, injecting the pressurized steam produced in said pressurized dryer into said combustion unit such that the pressure of the pressurized steam conducted into said combustion unit is substantially the same as the pressure in said combustion unit, and combusting the dried fuel in said combustion unit, thereby producing flue gases, passing said flue gases into said gas turbine and recovering the kinetic and thermal energy contained in said flue gases, driving a first generator using energy recovered by said gas turbine to produce electric energy, driving a compressor to pressurize said combustion unit using energy recovered by said gas turbine, supplying steam to a steam turbine and driving a second generator connected to said steam turbine to produce electric energy, recovering the thermal energy of the flue gases passed through the gas turbine by waste-heat recovery means, supplying thermal energy recovered by said waste-heat recovery means to said pressurized dryer such that the fuel is dried at least partly by said recovered thermal energy.

5. The method of claim 4, further comprising using thermal energy recovered by said waste-heat recovery means to heat the supply water for said steam turbine.

6. The method of claim 4, further comprising supplying thermal energy obtained from bled steam of said steam turbine to said pressurized dryer to dry the fuel.

7. The method of claim 4, further comprising recirculating the steam produced in said pressurized dryer through said waste-heat recovery means, superheating the recirculated steam in said waste-heat recovery means, and returning the superheated steam to said pressurized dryer where it delivers thermal energy to the drying of the fuel.

8. The apparatus of claim 1, wherein said pressurized dryer has a pressure from about 5 to about 50 bar.

9. The apparatus of claim 8, wherein said pressurized dryer has a pressure of about 12 bar.

10. The apparatus of claim 4, further comprising providing the pressure of the steam in said dryer at a level of from about 5 to about 50 bar.

11. The apparatus of claim 10, further comprising providing the pressure of the steam in said dryer at a level of about 12 bar.

* * * * *